US012808286B2

(12) United States Patent
Torkildsen

(10) Patent No.: US 12,808,286 B2
(45) Date of Patent: Nov. 24, 2026

(54) COMPRESSOR AND TURBINE SYSTEM FOR RESOURCE EXTRACTION SYSTEM

(71) Applicant: Cameron International Corporation, Houston, TX (US)

(72) Inventor: Bernt Helge Torkildsen, Sandsli (NO)

(73) Assignee: Cameron International Corporation, Houston, TX (US)

( * ) Notice: Subject to any disclaimer, the term of this patent is extended or adjusted under 35 U.S.C. 154(b) by 409 days.

(21) Appl. No.: 18/564,879

(22) PCT Filed: May 27, 2022

(86) PCT No.: PCT/US2022/031348
§ 371 (c)(1),
(2) Date: Nov. 28, 2023

(87) PCT Pub. No.: WO2022/251638
PCT Pub. Date: Dec. 1, 2022

(65) Prior Publication Data

US 2024/0263547 A1 Aug. 8, 2024

Related U.S. Application Data

(60) Provisional application No. 63/194,496, filed on May 28, 2021.

(51) Int. Cl.
*E21B 43/12* (2006.01)
*E21B 41/00* (2006.01)

(52) U.S. Cl.
CPC ..... *E21B 43/121* (2013.01); *E21B 41/0085* (2013.01)

(58) Field of Classification Search
CPC ..... E21B 43/121; E21B 41/0085; E21B 34/025
See application file for complete search history.

(56) References Cited

U.S. PATENT DOCUMENTS 3,939,356 A 2/1976 Loane
4,132,269 A 1/1979 Chasteen
(Continued)

FOREIGN PATENT DOCUMENTS

GB 2549558 A 10/2017
GB 2550325 A 11/2017
(Continued)

*Primary Examiner* — Kamini S Shah
*Assistant Examiner* — Michael Tang
(74) *Attorney, Agent, or Firm* — Kyle R. Miiller

(57) ABSTRACT

A resource extraction system includes a compressor and turbine system configured to extract a resource from a reservoir via a well and a control system configured to operate the resource extraction system in a first operating mode in response to determining a pressure of the resource exceeds a threshold pressure to operate the compressor and turbine system as a turbine and reduce the pressure of the resource and generate electrical energy in the first operating mode. The control system is also configured to operate the resource extraction system in a second operating mode in response to determining the pressure of the resource is below the threshold pressure to operate the compressor and turbine system as a compressor and increase the pressure of the resource in the second operating mode.

10 Claims, 8 Drawing Sheets

(56) References Cited

U.S. PATENT DOCUMENTS

| | | | | |
|---|---|---|---|---|
| 9,476,427 | B2 | 10/2016 | Torkildsen | |
| 2009/0014170 | A1 | 1/2009 | Zubrin | |
| 2010/0077749 | A1 | 4/2010 | Riley | |
| 2012/0247831 | A1 | 10/2012 | Kaasa | |
| 2013/0074757 | A1 | 3/2013 | McAlister | |
| 2014/0147243 | A1* | 5/2014 | Torkildsen | F04D 25/0686 414/803 |
| 2014/0236367 | A1* | 8/2014 | Ruiz Gomis | F03D 7/0272 700/287 |
| 2016/0380560 | A1 | 12/2016 | Torrey | |
| 2017/0077847 | A1 | 3/2017 | Torrey | |
| 2018/0179867 | A1* | 6/2018 | Artinian | F04D 25/024 |
| 2019/0292894 | A1 | 9/2019 | Xiao | |
| 2020/0224520 | A1 | 7/2020 | Curlett | |
| 2022/0364442 | A1 | 11/2022 | Petty | |
| 2024/0271591 | A1 | 8/2024 | Torkildsen | |

FOREIGN PATENT DOCUMENTS

| | | | | |
|---|---|---|---|---|
| WO | 2014083055 | A2 | 6/2014 | |
| WO | WO-2021158639 | A1 * | 8/2021 | F02C 6/14 |
| WO | WO-2022010344 | A1 * | 1/2022 | E21B 41/0064 |

* cited by examiner

COMPRESSOR AND TURBINE SYSTEM FOR RESOURCE EXTRACTION SYSTEM

CROSS-REFERENCE TO RELATED APPLICATION

This application is a National Stage entry of International Patent Application No. PCT/US2022/031348, filed on May 27, 2022, which claims priority to U.S. Provisional Application No. 63/194,496, entitled "SUBSEA POWER SYSTEM AND METHOD," filed May 28, 2021, which is hereby incorporated by reference in its entirety for all purposes.

BACKGROUND

This section is intended to introduce the reader to various aspects of the art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

In resource extraction operations, hydrocarbon fluids (e.g., oil and natural gas) are obtained from a subterranean geologic formation, referred to as a reservoir, by drilling a well that penetrates the subterranean geologic formation. The hydrocarbon fluid may then be extracted via the well and directed for further processing, such as refinement. Operation of a resource extraction system to extract the hydrocarbon fluid from a reservoir may consume energy, such as electrical energy. For example, during an initial phase of gas field production (e.g., plateau production phase of gas fields), a reservoir pressure energy exceeds a pressure energy sufficient to transport the gas (or wet gas) to its processing equipment. As a result, subsea and/or topside chokes may be used to reduce or choke down this excess fluid pressure. Unfortunately, the use of chokes represents a regrettable waste of energy.

It would thus be beneficial to extract this energy and convert it into electric energy through a subsea turbine and generator system and method as proposed in the present disclosure.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a resource extraction system includes a compressor and turbine system configured to extract a resource from a reservoir via a well and a control system configured to operate the resource extraction system in a first operating mode in response to determining a pressure of the resource exceeds a threshold pressure to operate the compressor and turbine system as a turbine and reduce the pressure of the resource and generate electrical energy in the first operating mode. The control system is also configured to operate the resource extraction system in a second operating mode in response to determining the pressure of the resource is below the threshold pressure to operate the compressor and turbine system as a compressor and increase the pressure of the resource in the second operating mode.

In an embodiment, a non-transitory computer-readable medium includes instructions that, when executed by processing circuitry, cause the processing circuitry to operate a resource extraction system in a first operating mode in response to determining a pressure of resource flow extracted by the resource extraction system is above a threshold pressure to reduce the pressure of resource flow via a turbine configured to receive the resource flow and be driven to rotate by the resource flow to generate electrical energy, and operate the resource extraction system in a second operating mode in response to determining that the pressure of resource flow is below the threshold pressure to increase the pressure of the resource flow via a compressor.

In an embodiment, a system includes a compressor and turbine system configured to receive a resource flow from a reservoir and a control system configured to operate the compressor and turbine system to enable the resource flow to drive rotation of the compressor and turbine system to reduce a pressure of the resource flow and generate electrical energy via the rotation of the compressor and turbine system in response to determining the pressure of the resource flow exceeds a threshold pressure, and operate the compressor and turbine system to pressurize the resource flow in response to determining the pressure of the resource flow is below the threshold pressure.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
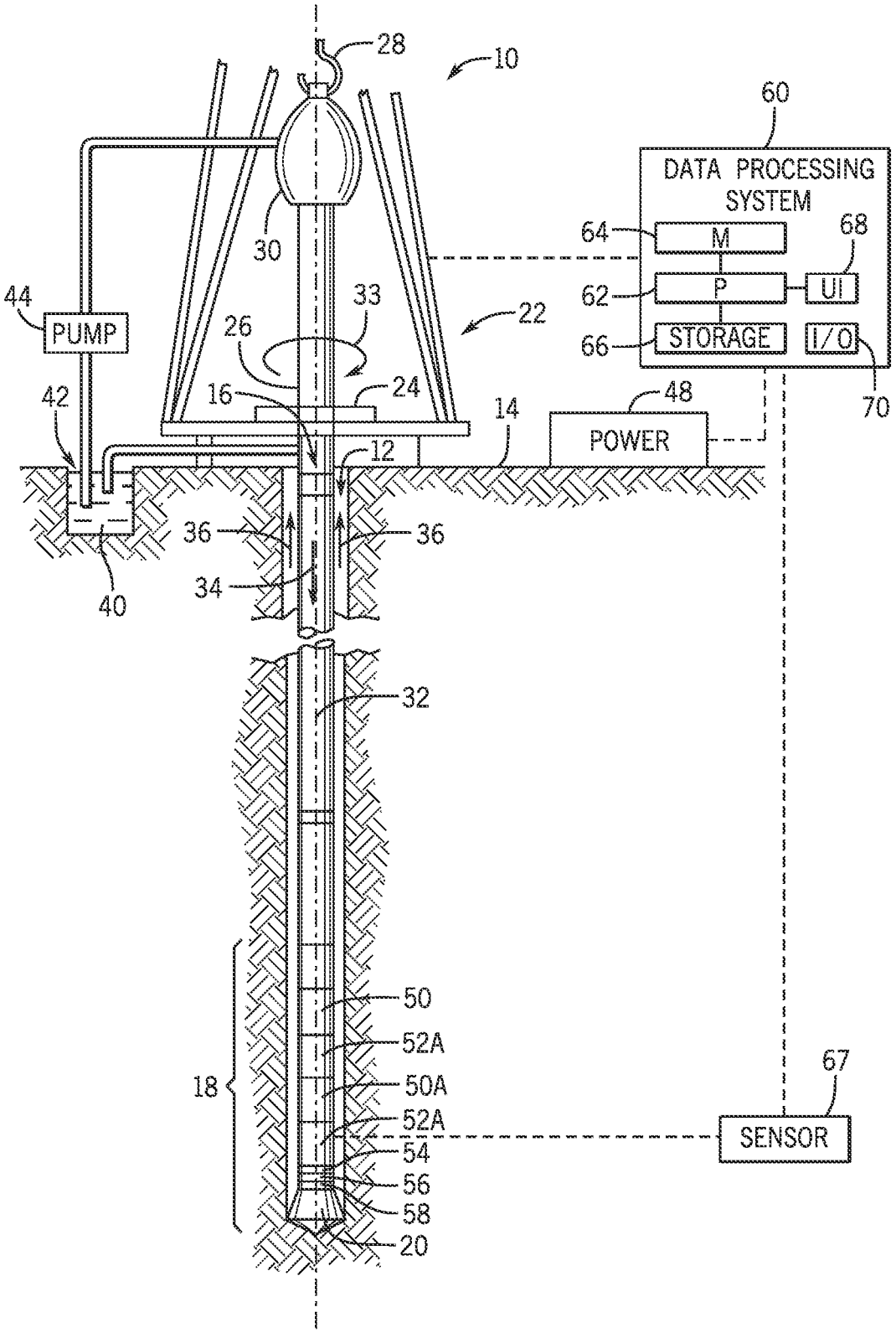
FIG. 1 is a schematic illustration of a resource extraction system that may be used to extract resources, such as hydrocarbon fluids, according to an embodiment of the present disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

One or more specific embodiments of the present disclosure will be described below. The particulars shown herein are by way of example, and for purposes of illustrative discussion of the embodiments of the subject disclosure only, and are presented in the cause of providing what is believed to be the most useful and readily understood description of the principles and conceptual aspects of the subject disclosure. In this regard, no attempt is made to show structural details of the subject disclosure in more detail than is necessary for the fundamental understanding of the subject disclosure, the description taken with the drawings making apparent to those skilled in the art how the several forms of the subject disclosure may be embodied in practice. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are used in an open-ended fashion, and thus should be interpreted to mean "including, but not limited to." Also, any use of any form of the terms "connect," "engage," "couple," "attach," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience but does not require any particular orientation of the components relative to some fixed reference, such as the direction of gravity. The term "fluid" encompasses liquids, gases, vapors, and combinations thereof. Numerical terms, such as "first," "second," and "third" are used to distinguish components to facilitate discussion, and it should be noted that the numerical terms may be used differently or assigned to different elements in the claims.

Certain terms are used throughout the description and claims to refer to particular features or components. As one skilled in the art will appreciate, different persons may refer to the same feature or component by different names. This document does not intend to distinguish between components or features that differ in name, but not function.

This disclosure herein generally involves a resource extraction system. A resource extraction system may extract resources, such as hydrocarbon fluid (e.g., oil and natural gas), from a reservoir. For example, a drilling system may form a wellbore through a surface (e.g., an onshore surface, an offshore surface) and into the reservoir to enable access of the resources within the reservoir. The resource extraction system may utilize the wellbore to extract the resources from the reservoir. In some embodiments, the resource extraction system may direct the resources from the reservoir, through the wellbore, and to a resource processing system or facility, which may then process the resources, such as to refine the resources and/or develop products via the resources.

The resource extraction system may utilize a pressure of the reservoir to facilitate extraction of resources. For example, when the pressure is relatively high in the reservoir, a resource flow (e.g., liquid resource flow) may be naturally forced through the well for extraction without the need for any additional device to pressurize the resource flow. In some circumstances, the pressure of the resource flow may exceed one or more threshold pressures for the equipment of the resource extraction system, such as casings, tubing, valves, seals, and the like. As a result, the pressure of the resource flow may be reduced toward a target pressure based on the threshold pressures to protect the equipment. When the pressure of the reservoir is low, such as after extraction of a certain amount of the resource from the reservoir, the resource may not naturally flow at a desirable rate through the well for extraction. For this reason, the resource may be pressurized via one or more devices, such as compressors, pumps, or other suitable boosters, to enable desirable flow of the resource for extraction.

It may be desirable to improve operation of the resource extraction system. As an example, it may be desirable to improve efficiency of the resource extraction system, such as by reducing an overall amount of energy (e.g., electrical energy) consumed to operate the resource extraction system. Thus, embodiments of the present disclosure are directed to a resource extraction system with a compressor and turbine system configured to generate electrical energy during operation of the resource extraction system. The compressor and turbine system may operate as either a turbine to be driven by a fluid flow (e.g., in a first operating mode) or as a compressor (e.g., a wet gas compressor and/or a multiphase compressor that may be operable for liquid flows) to drive a fluid flow (e.g., in a second operating mode). For example, the compressor and turbine system may include a single device that can operate as either the compressor or the turbine, such as in separate operating modes, or the compressor and turbine system may include a separate compressor and turbine, and either one of the compressor or turbine may be in operation to operate the compressor and turbine system to drive a fluid flow or be driven by the fluid flow.

As an example, the compressor and turbine system may operate in a first operating mode while the pressure of the resource flow is above a threshold pressure. During the first operating mode, the compressor and turbine system may reduce the pressure of the resource flow to provide a desirable resource flow for the resource extraction system. For example, the resource flow may be directed through the compressor and turbine system to drive rotation of the compressor and turbine system, and the rotation of the compressor and turbine system may cause a generator to generate electrical energy. Such operation of the compressor and turbine system may impart a flow resistance onto the resource flow, such as by causing the resource flow to transfer energy to drive rotation of the compressor and turbine system, thereby reducing the pressure of the resource flow. Additionally, the generated electrical energy may reduce overall energy consumption. For instance, the generated electrical energy may be utilized by the resource extraction system, the resource processing system, an electrical grid, or so forth, to reduce an operational cost associated with consumption of energy.

In certain embodiments, the compressor and turbine system may also operate in a second operating mode while the pressure of the resource flow is below a threshold pressure. During the second operating mode, the compressor and turbine system may increase the pressure of the resource flow. That is, the compressor and turbine system may pressurize the resource flow to enable the resource to more readily flow for extraction. As an example, the compressor and turbine system may consume the electrical energy generated via operation of the compressor and turbine system in the first operating mode. In this manner, operation of the compressor and turbine system in the first operating mode may reduce an amount of electrical energy utilized from an external energy source (e.g., the electrical grid, a renewable energy source), thereby increasing efficient energy usage associated with the resource extraction system.

Although the present disclosure primarily describes the resource extraction system as having a subsystem (e.g., a compressor and turbine system) configured to operate as a compressor to pressurize a resource flow, it should be noted that such a subsystem may operate as any suitable device to pressurize the resource flow. For example, the subsystem may operate as a pump or any other suitable booster configured to pressurize the resource flow (e.g., liquid resource flow) in an operating mode and to operate as a turbine configured to generate energy in a different operating mode.

To help illustrate the techniques described herein, FIG. 1 shows one embodiment of a resource extraction system 10 at a well site, in which the resource extraction system 10 may be used to form a borehole 12 (e.g., wellbore) through geological formations 14 that may be onshore or offshore. In some embodiments, the resource extraction system 10 may also facilitate milling operations to cut metal objects to be removed from the borehole 12 and/or plugging and abandonment operations to close the borehole 12. The resource extraction system 10 may include a drill string 16 suspended within the borehole 12, and the resource extraction system 10 may have a bottom hole assembly (BHA) 18 that includes a drill bit 20 at its lower end, in which the drill bit 20 engages the geological formations 14. The drill bit 20 includes any cutting structure (e.g., a reamer) that may be used to engage and cut the geological formations 14.

The resource extraction system 10 also includes a surface system 22 that rotates and drives the drill string 16. In some embodiments, the resource extraction system 10 may include a kelly system having a rotary table 24, a kelly 26, a hook 28, and a rotary swivel 30. The drill string 16 may be coupled to the hook 28 through the kelly 26 and the rotary swivel 30. The rotary swivel 30 may be suspended from the hook 28 that is attached to a traveling block (not shown) that drives the drill string 16 relative to the surface system 22 along an axis 32 that extends through a center of the borehole 12. Furthermore, the rotary swivel 30 may permit rotation of the drill string 16 relative to the hook 28, and the rotary table 24 may rotate in a rotational direction 33 to drive the drill string 16 to rotate concentrically about the axis 32. Alternatively, the resource extraction system 10 may be a top drive system that rotates the drill string 16 via an internal drive (e.g., an internal motor) of the rotary swivel 30. That is, the resource extraction system 10 may not use the rotary table 24 and the kelly 26 to rotate the drill string 16. Rather, the internal drive of the rotary swivel 30 may drive the drill string 16 to rotate in the rotational direction 33 relative to the hook 28 concentrically about the axis 32.

As the surface system 22 rotates the drill string 16, the surface system 22 may further drive the drill string 16 in axial directions to engage the drill string 16 with the geological formations 14. For example, the drill string 16 may be driven into the geological formation 14 through the borehole 12 in a first axial direction 34, which may be a generally downward vertical direction. Additionally, the drill string 16 may be removed from the borehole 12 in a second axial direction 36 opposite the first axial direction 34. That is, the second axial direction 36 may be a generally upward vertical direction. The combined axial and rotational movement of the drill string 16 may facilitate engagement of the drill string 16 with the geological formations 14. Although FIG. 1 illustrates that the drill string 16 is driven in generally vertical directions, the drill string 16 may navigate through the borehole 12 in directions crosswise to the first and second axial directions 34, 36, such as transitioning to a generally horizontal direction.

The surface system 22 may also include mud or drilling fluid 40 that may be directed into the drill string 16 to cool and/or lubricate the drill bit 20. Additionally, the drilling fluid 40 may exert a mud pressure on the geological formations 14 to reduce the likelihood of fluid from the geological formations 14 flowing into and/or out of the borehole 12. In some embodiments, the drilling fluid 40 may be stored in a pit 42 formed at the well site. A pump 44 may fluidly couple the pit 42 and the swivel 30 to one another, in which the pump 44 may deliver the drilling fluid 40 to the interior of the drill string 16 via a port in the swivel 30, causing the drilling fluid 40 to flow downwardly through the drill string 16 in the first axial direction 34. The drilling fluid 40 may also exit the drill string 16 via ports in the drill bit 20 and flow into the borehole 12 toward the surface (e.g., toward the surface system 22). While drilling, the drilling fluid 40 may circulate upwardly in the second axial direction 36 through an annulus region between the outside of the drill string 16 and a wall of the borehole 12, thereby carrying drill cuttings away from the bottom of the borehole 12. Once at the surface, the returned drilling fluid 40 may be filtered and conveyed back to the pit 42 for recirculation and reuse.

The BHA 18 of the resource extraction system 10 of FIG. 1 may include various downhole tools, such as a logging-while-drilling (LWD) module 50 and/or a measuring-while-drilling (MWD) module 52. Generally, the downhole tools may facilitate determining a performance of the drill string 16, such as by determining a parameter of the drill string 16, of the surrounding geological formation 14, and the like. It should also be noted that more than one LWD module 50 and/or MWD module 52 may be employed. For example, the BHA 18 may include an additional LWD module 50A and/or an additional MWD module 52A positioned adjacent to the drill bit 20. As such, references made to the LWD module 50 may also refer to the LWD module 50A and references made to the MWD module 52 may also refer to the MWD module 52A.

The LWD module 50 and/or the MWD module 52 may each be housed in a special type of drill collar and may contain one or more types of logging tools. In general, the LWD module 50 may include capabilities for measuring, processing, and storing information, and the MWD module 52 may contain one or more devices for measuring characteristics of the drill string 16 and/or the drill bit 20, as well as for communicating with surface equipment. In the resource extraction system 10 of FIG. 1, the LWD module 50 and/or the MWD module 52 may include one or more of the following types of measuring devices: a weight-on-bit measuring device, a torque measuring device, a bend measuring device, a vibration measuring device, a shock measuring device, a stick slip measuring device, a direction measuring device, and/or an inclination measuring device.

In certain embodiments, the BHA 18 may also include an apparatus for generating electrical energy. For example, the BHA 18 may include a compressor and turbine system that may generate electrical energy from the flow of fluid (e.g., the drilling fluid 40, fluid from the geological formations 14) through the borehole 12. The electrical energy generated by the BHA 18 may be used to provide energy to the resource extraction system 10. In additional or alternative embodiments, the resource extraction system 10 may include a power source 48, such as an electrical generator and/or an electrical energy storage device, that supplies energy to the resource extraction system 10. In any case, electrical energy may be used to operate the aspects of the resource extraction system 10, such as to control the BHA 18.

The BHA 18 may further include a motor 54 and/or a rotary-steerable system (RSS) 56 coupled to the drill bit 20 via additional tubulars 58. The motor 54 and/or the RSS 56 are used to regulate operation of the drill bit 20 to engage with the geological formations 14. For example, the RSS 56 may orient the drill bit 20 in a desirable direction while the motor 54 causes the drill bit 20 to rotate continuously to drill the borehole 12. Generating continuous rotation may enable improved transportation of drilled cuttings to the surface, better cutting of the borehole 12, limited stress imparted upon the drill bit 20 by the geological formations 14, and so forth. Furthermore, the RSS 56 may enable control of the engagement of the drill string 16 with the geological formations 14. By way of example, the RSS 56 may place the drill string 16 in communication with the surface system 22. As such, the surface system 22 may control a direction or path for the drill string 16 to form the borehole 12 and/or a manner in which the drill string 16 engages with the geological formations 14 (e.g., a rotation of the drill string 16).

In certain embodiments, the drill string 16 may include or be communicatively coupled with a data processing system 60 that may adjust the operation of the resource extraction system 10, such as to direct the drill string 16 through the borehole 12. The data processing system 60 may include one or more processors 62, such as a general purpose microprocessor, an application specific processor (ASIC), and/or a field programmable gate array (FPGA) or other programmable logic device. The one or more processors 62 may execute instructions stored in a memory 64 and/or a storage 66, which may be read-only memory (ROM), random-access memory (RAM), flash memory, an optical storage medium, a hard disk drive, and the like. The data processing system 60 may further be communicatively coupled with a sensor 67 that may determine an operating parameter of the drill string 16. As an example, the sensor 67 may be a position sensor, and the operating parameter may indicate an orientation of the drill string 16. The sensor 67 may transmit signals or data to the data processing system 60 indicative of the operating parameter. The data processing system 60 may operate the resource extraction system 10, such as to adjust the direction through which the drill string 16 forms the borehole 12, based on the signals received from the sensor 67.

Although the illustrated embodiment of the data processing system 60 is located external to the drill string 16, the data processing system 60 may alternatively be a part of the drill string 16, such as disposed within the BHA 18. The data processing system 60 may alternatively be a device located proximate to the drilling operation (e.g., at the surface system 22) and/or a remote data processing device located away from the resource extraction system 10, such as a mobile computing device (e.g., tablet, smart phone, laptop) or a server remote from the resource extraction system 10. The data processing system 60 may process downhole measurements in real time or sometime after the data has been collected. In general, the data processing system 60 may store and process collected data, such as data collected in the BHA 18 via the LWD module 50, the MWD module 52, and/or any suitable telemetry (e.g., electrical signals pulsed through the geological formations 14 or mud pulse telemetry using the drilling fluid 40). In further embodiments, separate data processing systems 60 may be used to direct the drill string 16, to rotate the drill string 16, and/or to raise or lower the drill string 16.

In some embodiments, the data processing system 60 may also include a user interface 68 that may enable a user to interact with the data processing system 60. For example, the user may input properties and/or instructions (e.g., control commands) to the data processing system 60 via the user interface 68. To this end, the user interface 68 may include a button, a keyboard, a microphone, a mousing device, a trackpad, and the like. The user interface 68 may also include a display, which may be any suitable electronic display that displays visual representations of information, such as graphical representations of collected data.

Further still, the data processing system 60 may include input/output (I/O) ports 70 that enable the data processing system 60 to communicate with various electronic devices. For example, the I/O ports 70 may enable the data processing system 60 to directly couple to another electronic device (e.g., a mobile device) to enable data to transfer between the data processing system 60 and the electronic device. The I/O ports 70 may additionally or alternatively enable the data processing system 60 to indirectly couple to other electronic devices. In another example, the I/O ports 70 may enable the data processing system 60 to couple to a network, such as a personal area network (PAN), a local area network (LAN), and/or a wide area network (WAN). Accordingly, in some embodiments, the data processing system 60 may receive data (e.g., as signals) from another electronic device (e.g., a base-station control system) and/or communicate data to another electronic device via the I/O ports 70.

After the borehole 12 has been formed via the resource extraction system 10, a resource flow may be directed through the borehole 12, such as in the second axial direction 36, for extraction. As an example, the borehole 12 may extend to a reservoir containing the resource flow, and the reservoir may be sufficiently pressurized to drive the resource flow through the borehole 12. Energy from the resource flow may be harnessed to operate the resource extraction system 10. For instance, as described herein, mechanical energy may be extracted from the resource flow and used to generate electrical energy, and the electrical energy may be utilized to operate a component of the resource extraction system 10.

Figure 2:
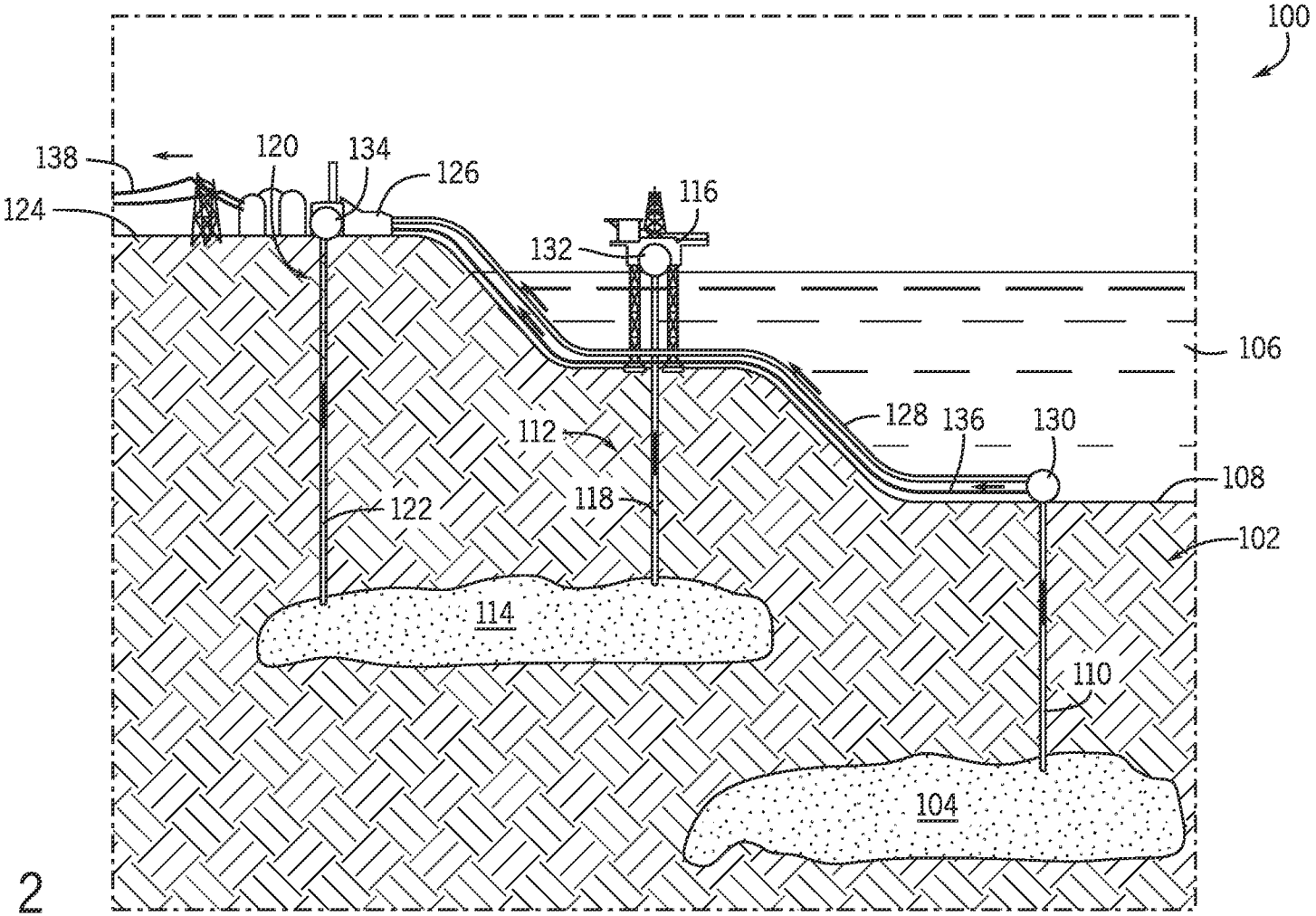
FIG. 2 is a schematic illustration of a system that includes multiple resource extraction systems configured to extract resources from different reservoirs, and each resource extraction system includes a compressor and turbine system, according to an embodiment of the present disclosure.

FIG. 2 is a schematic illustration of a system 100, such as a resource extraction and processing system, that may include multiple resource extraction systems. For example, a first resource extraction system 102 may extract resources (e.g., hydrocarbon fluid) from a first reservoir 104, which may be positioned beneath a body of water 106 (e.g., an ocean). The first resource extraction system 102 may include a subsea system positioned on the sea floor 108 and may extract resources from the first reservoir 104 via a first well 110 that may extend through the sea floor 108 and into the first reservoir 104. A second resource extraction system 112 may extract resources from a second reservoir 114, which may also be positioned beneath the body of water 106. The second resource extraction system 112 may include an offshore system 116 (e.g., an oil platform, an oil rig, a floating rig) at least partially exposed above the body of water 106. Thus, the second resource extraction system 112 may extract resources from the second reservoir 114 via a second well 118 that extends through the sea floor 108 and the body of water 106 and into the second reservoir 114. Additionally, the second reservoir 114 may be accessible via onshore drilling. As an example, a third resource extraction system 120 may extract resources from the second reservoir 114 via a third well 122 that extends through a dry land surface 124 and into the second reservoir 114. Thus, each of the resource extraction systems 102, 112, 120 may extract resources from the reservoirs 104, 114 via different wells 110, 118, 122.

The resources extracted from the respective reservoirs 104, 114 may be processed offsite. For instance, the system 100 may include a resource processing system or facility 126, which may receive the extracted resources and perform various operations, such as refinement, product development, and/or transportation of the resources. By way of example, the third well 122 may be a part of the resource processing system 126, and the resource processing system 126 may therefore directly receive resources from the second reservoir 114 via the third well 122. Additionally or alternatively, the system 100 may include a pipeline system 128, which may include a conduit or tubing, configured to deliver resources to the resource processing system 126. For example, the pipeline system 128 may fluidly couple the first well 110 to the resource processing system 126 and/or the second well 118 to the resource processing system 126. Thus, the pipeline system 128 may direct resources extracted by the first resource extraction system 102 and/or by the second resource extraction system 112 to the resource processing system 126. In further embodiments, the offshore system 116 may receive the extracted resources from any of the reservoirs 104, 114, such as via the pipeline system 128. In this manner, the resource extraction systems 102, 112, 120 may share various electrical, mechanical, and/or process infrastructures with the offshore system 116 and/or the resource processing system 126 to reduce costs associated with implementing dedicated equipment for operation of the resource extraction systems 102, 112, 120, the offshore system 116, and/or the resource processing system 126.

Operation of the resource extraction systems 102, 112, 120 may be based on a pressure of resource flows from the reservoirs 104, 114. For example, the pressure of the resource flows may establish a flow characteristic, such as a pressure, flowrate, and/or amount, of resources readily flowing through the wells 110, 118, 122 for extraction. The resource extraction systems 102, 112, 120 may operate to accommodate the change in the flow characteristic and more efficiently and/or effectively extract resources from the reservoirs 104, 114. In some circumstances, the pressure of the resource flows from the reservoirs 104, 114 may change over time, such as because of a change in amount of resources within the reservoir 104, 114 caused by extraction operations via the resource extraction systems 102, 112, 120.

As an example, during a respective first period of time, such as a beginning stage of a reservoir life cycle, the reservoirs 104, 114 may have a relatively high pressure that causes flow of resources naturally through the wells 110, 118, 122 at above a threshold, rated, or desirable pressure at which the resource extraction systems 102, 112, 120 may extract resources. For this reason, the resource extraction systems 102, 112, 120 may operate to reduce the pressure of resources flowing through the wells 110, 118, 122, such as below the threshold pressure, during the first period of time. As another example, during a respective second period of time, such as an intermediate stage of the reservoir life cycle, the pressure of reservoirs 104, 114 may be relatively low. For instance, during the second period of time, the resources may not naturally flow at the threshold pressure through the wells 110, 118, 122. Therefore, the resource extraction systems 102, 112, 120 may operate to increase pressurization of the resources during the second period of time.

To this end, each of the resource extraction systems 102, 112, 120 may include a compressor and turbine system (e.g., a rotary system or turbomachinery) that may operate to reduce pressure of the flow of resources (e.g., while the pressure within the reservoirs 104, 114 is relatively high) and to increase pressure of the flow of resources (e.g., while the pressure within the reservoirs 104, 114 is relatively low). That is, the first resource extraction system 102 may include a first compressor and turbine system 130 configured to adjust the pressure of resource flow through the first well 110, the second resource extraction system 112 may include a second compressor and turbine system 132 configured to adjust the pressure of resource flow through the second well 118, and the third resource extraction system [102] 120 may include a third compressor and turbine system 134 configured to adjust the pressure of resource flow through the third well 122. The compressor and turbine systems 130, 132, 134 may be positioned at any suitable location, such as at the sea floor 108, above the body of water 106, within one of the wells 110, 118, 122, and so forth, to adjust pressure of resource flow through the corresponding wells 110, 118, 122. The compressor and turbine systems 130, 132, 134 may operate independently of one another to adjust the respective resource flows through the wells 110, 118, 122 to provide more suitable resource flows during extraction. In additional or alternative embodiments, the system 100 may include a different number of compressor and turbine systems. For example, a single compressor and turbine system (e.g., a shared or common compressor and turbine system) may operate to control pressure of resource flow through multiple wells, thereby reducing a number of compressor and turbine systems that may be implemented in the system 100.

Each of the compressor and turbine systems 130, 132, 134, and therefore each of the resource extraction systems 102, 112, 120, may operate in a first operating mode, which may be a turbine mode, and a second operating mode, which may be a compressor mode. During the first operating mode, the compressor and turbine systems 130, 132, 134 may impart a flow resistance onto the resource flow to reduce the pressure of the resource flow. For example, the compressor and turbine systems 130, 132, 134 may operate in the first operating mode while the pressure of the resource flow is above the threshold pressure, and the compressor and turbine systems 130, 132, 134 may reduce the pressure of the resource flow toward the threshold pressure. Flow of the resource through the compressor and turbine systems 130, 132, 134 may cause movement of a turbine of the compressor and turbine systems 130, 132, 134. The relatively high pressure drives the turbine, thereby simultaneously extracting mechanical energy and reducing the pressure of the resource flow. For example, each compressor and turbine system 130, 132, 134 may be coupled to an electrical generator configured to convert the mechanical energy associated with the movement of the turbine, as caused by resource flow, into electrical energy as the turbine drives the generator. Therefore, the compressor and turbine system 130, 132, 134 may generate electrical energy in the first operating mode. In certain embodiments, the turbine may include a single stage or multi-stage turbine (e.g., 2, 3, 4, 5, or more stage turbine). Additionally, the turbine may include an axial turbine, a radial turbine, a contra-rotating turbine, or any combination of turbines.

In some embodiments, the electrical energy generated by the compressor and turbine systems 130, 132, 134 operating in the first operating mode may be used to facilitate operation of the system 100. For example, the system 100 may include an electrical connector 136 (e.g., a wire, a cable, a conductor) electrically connected to any of the compressor and turbine systems 130, 132, 134. The electrical connector 136 may receive the electrical energy generated by the compressor and turbine systems 130, 132, 134 and direct the electrical energy to another part of the system 100.

For instance, the electrical connector 136 may also be electrically coupled to components of the resource processing system 126, and the components may receive the generated electrical energy and utilize the electrical energy to operate various functions of the resource processing system 126. The components receiving the electrical energy may include electrical actuators coupled to valves, monitoring equipment (e.g., monitoring electronics, sensors), control equipment (e.g., local or distributed controllers), or any combination thereof. Additionally or alternatively, another component, such as any of the compressor and turbine systems 130, 132, 134 and/or of the offshore system 116, may receive and utilize the generated electrical energy to operate. In this manner, operation of the compressor and turbine systems 130, 132, 134 in the first operating mode may reduce an overall amount of energy consumed by the system 100. In further embodiments, the electrical energy generated via operation of the compressor and turbine systems 130, 132, 134 in the first operating mode may be stored for later usage (e.g., in one or more batteries), such as to operate the compressor and turbine systems 130, 132, 134 in the second operating mode as described herein. Further still, the electrical energy generated via operation of the compressor and turbine systems 130, 132, 134 in the first operating mode may be distributed to an electrical grid 138 and used to reduce a cost associated with energy consumption (e.g., energy received from the electrical grid 138). In any case, operation of the compressor and turbine systems 130, 132, 134 in the first operating mode may improve energy efficiency associated with the system 100.

During the second operating mode, the compressor and turbine systems 130, 132, 134 may increase the pressure of the resource flow. For instance, the compressor and turbine systems 130, 132, 134 may operate in the second operating mode while the pressure of the resource flow is below the threshold pressure, and the compressor and turbine systems 130, 132, 134 may increase the pressure of the resource flow toward the threshold pressure. By way of example, the compressor and turbine systems 130, 132, 134 may include a compressor configured to compress the resource flow to pressurize the resource flow. Pressurization of the resource flow may achieve a desirable flow rate of the resource flow through the wells 110, 118, 122 for extraction from the reservoirs 104, 114. During the second operating mode, the compressor and turbine systems 130, 132, 134 may consume energy to pressurize the resource flow. For instance, each compressor and turbine system 130, 132, 134 may be coupled to an electric motor configured to receive electrical energy, such as electrical energy from the electrical grid 138 and/or electrical energy previously generated and stored (e.g., in one or more batteries) during operation of the compressor and turbine systems 130, 132, 134 in the first operating mode, to drive operation of the compressor. In certain embodiments, the compressor may include a single stage or multi-stage compressor (e.g., 2, 3, 4, 5, or more stage compressor). Additionally, the compressor may include a reciprocating compressor (e.g., piston-cylinder compressor), an axial compressor, a centrifugal compressor, or a compression system having any combination thereof.

As described herein, the compressor and turbine systems 130, 132, 134 may readily transition between the first operating mode and the second operating mode, such as without having to modify currently implemented components of and/or implement additional components to the system 100. For example, the compressor and turbine systems 130, 132, 134 may operate in a particular operating mode based on a pressure of the resource flow. Indeed, the operating mode of the compressor and turbine systems 130, 132, 134 may be automatically selected and effectuated to provide a resource flow that may be more suitable or desirable for operation of the system 100.

Figure 3:
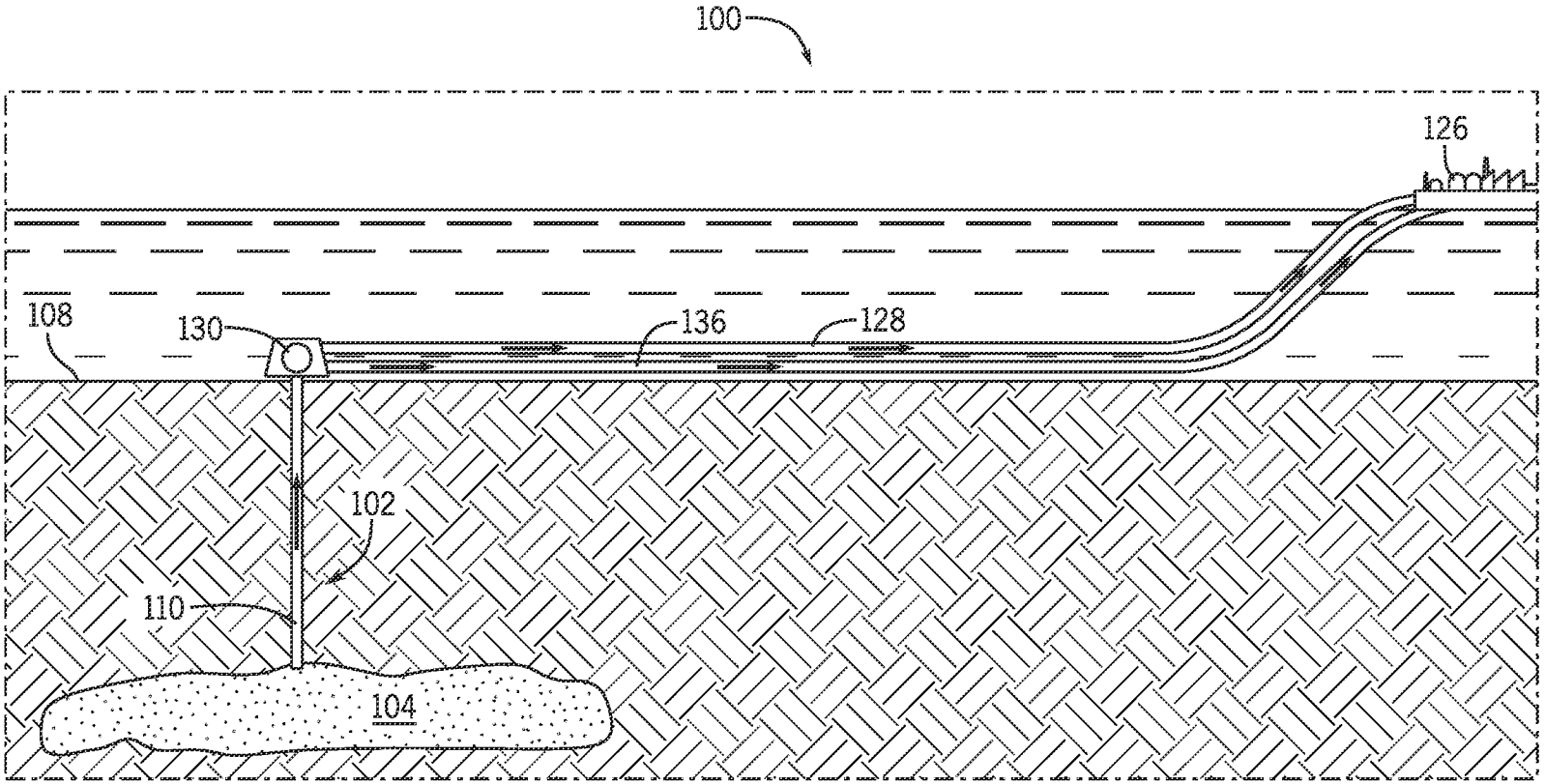
FIG. 3 is a schematic illustration of a resource extraction system that includes a compressor and turbine system operating in a turbine mode, according to an embodiment of the present disclosure.

FIG. 3 is a schematic illustration of the system 100 having the first compressor and turbine system 130 operating in the first operating mode. Although FIG. 3 is primarily described with respect to the first compressor and turbine system 130 positioned on the sea floor 108 and configured to extract resources from the first reservoir 104, the features discussed herein may be applied to any of the compressor and turbine systems 130, 132, 134. As discussed above, the first compressor and turbine system 130 may operate in the first operating mode to reduce a pressure of the resource flow, such as through the first well 110 and/or the pipeline system 128 toward the resource processing system 126. For example, the first compressor and turbine system 130 may extract mechanical energy from the resource flow to reduce an amount of energy of the resource flow, thereby reducing the pressure of the resource flow. Resource flow through the first compressor and turbine system 130 may cause generation of electrical energy. For instance, the resource flow may drive movement of a turbine of the first compressor and turbine system 130, and a generator coupled to the first compressor and turbine system 130 may generate electrical energy via the movement of the turbine. The generated electrical energy may then be utilized, such as by the resource processing system 126 via the electrical connector 136, to enable operation of the system 100.

Figure 4:
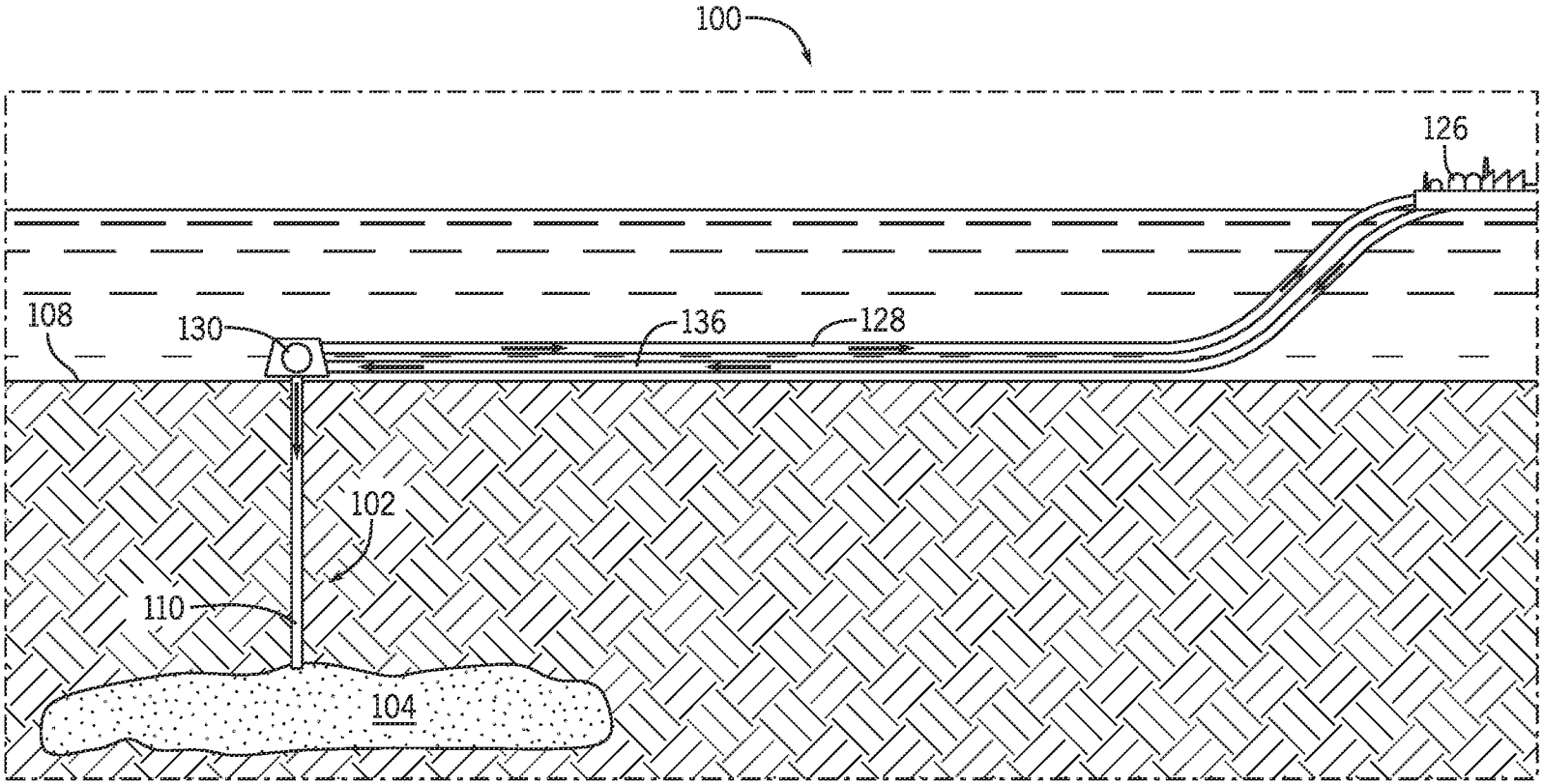
FIG. 4 is a schematic illustration of a resource extraction system that includes a compressor and turbine system operating in a compressor mode, according to an embodiment of the present disclosure.

FIG. 4 is a schematic illustration of the system 100 having the first compressor and turbine system 130 operating in the second operating mode. Although FIG. 4 is primarily described with respect to the first compressor and turbine system 130 positioned on the sea floor 108 and configured to extract resources from the first reservoir 104, the features discussed herein may be applied to any of the compressor and turbine systems 130, 132, 134. The first compressor and turbine system 130 may operate in the second operating mode to increase a pressure of the resource flow, such as through the first well 110 and/or the pipeline system 128 toward the resource processing system 126. For example, a compressor of the first compressor and turbine system 130 may operate to pressurize the resource flow. Operation of the compressor may consume electrical energy. Thus, electrical energy may be directed to the first compressor and turbine system 130 via the electrical connector 136 to operate the first compressor and turbine system 130 in the second operating mode. In certain embodiments, the electrical energy used to drive the compressor may be supplied from one or more batteries of an energy storage system, which may store electricity generated by the generator while the first compressor and turbine system 130 is operating in the first operating mode.

Figure 5:
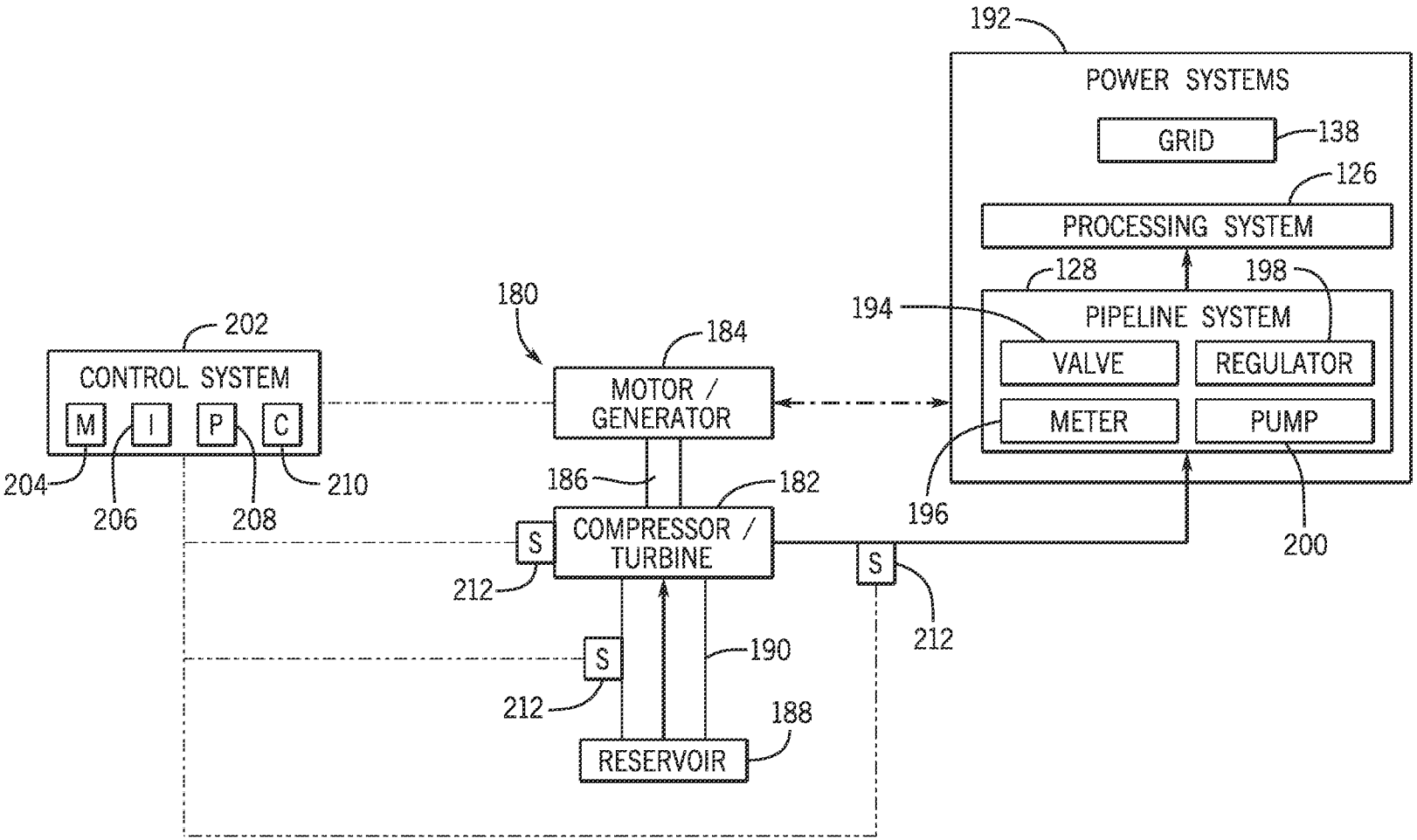
FIG. 5 is a schematic illustration of a resource extraction system that includes a combined compressor and turbine system, according to an embodiment of the present disclosure.

FIG. 5 is a schematic illustration of an embodiment of a resource extraction system 180, which may be representative of any of the resource extraction systems 102, 112, 120. The resource extraction system 180 may include a combined compressor and turbine 182 (e.g., a reversible compressor/turbine that can operate as a compressor in an operating mode and as a turbine in a different operating mode), which may include a single component, system, or assembly that can switch operation between a compressor and a turbine. The combined compressor and turbine 182 may be coupled to a combined motor and generator 184 via a shaft 186. The shaft 186 may enable rotation of one of the combined compressor and turbine 182 and the combined motor and generator 184 to drive rotation of the other of the combined compressor and turbine 182 and the combined motor and generator 184. By way of example, in the first operating mode, the combined compressor and turbine 182 is driven to rotate by the resource flow and drives rotation of the combined motor and generator 184 via the shaft 186, thereby generating electricity using mechanical energy extracted from the resource flow. Thus, in the first operating mode, the combined compressor and turbine 182 functions as a turbine while the combined motor and generator 184 functions as an electrical generator. In the second operating mode, the combined motor and generator 184 is driven to rotate by electricity and drives rotation of the combined compressor and turbine 182 via the shaft 186, thereby using electricity to perform work on (i.e., compression of) the resource flow. Thus, in the second operating mode, the combined compressor and turbine 182 functions as a compressor while the combined motor and generator 184 functions as an electrical motor.

The resource extraction system 180 may extract resources from a reservoir 188 via a well 190. The resource may flow from the reservoir 188 through the combined compressor and turbine 182 via the well 190 in both operating modes. For example, the resource flow may be directed through the combined compressor and turbine 182 via the pipeline system 128 and to the resource processing system 126. In the first operating mode, the resource flow may drive rotation of the combined compressor and turbine 182, and the mechanical energy of the resource flow used to drive rotation of the combined compressor and turbine 182 may reduce pressure of the resource flow. As a result, the combined compressor and turbine 182 may operate as a turbine in the first operating mode to enable the resource extraction system 180 to reduce the pressure of the resource flow. Additionally, rotation of the combined compressor and turbine 182 may drive rotation of the combined motor and generator 184 via the shaft 186, and the combined motor and generator 184 may operate as an electrical generator configured to generate electrical energy via the rotation of the combined motor and generator 184.

The electrical energy generated in the first operating mode may be utilized to enable operation of various power systems 192. As an example, the electrical energy may be distributed or returned to the electrical grid 138 to reduce a cost associated with consuming electrical energy received from the electrical grid 138. As another example, the electrical energy may be used to enable operation of the resource processing system 126, such as to process the resource extracted from the reservoir 188. As a further example, the electrical energy may be used to enable operation of the pipeline system 128. For instance, the electrical energy may be used to enable operation of a valve 194 (e.g., a solenoid valve) configured to direct flow of the resource through the pipeline system 128 (e.g., to enable or block flow of the resource to different parts of the pipeline system 128), a sensor or meter 196 configured to monitor a parameter (e.g., a flow rate, pressure, temperature, fluid composition, water content) associated with flow of the resource through the pipeline system 128, a regulator 198 configured to maintain (e.g., restrict) a flow rate of the resource through the pipeline system 128, and/or a pump 200 configured to increase a flow rate of the resource through the pipeline system 128. However, the generated electrical energy may be used to enable operation of any other suitable equipment, such as other power monitoring equipment, equipment configured to drill (e.g., toward the reservoir 188) to form an additional well, equipment configured to produce hydrogen via a body of water in which the resource extraction system 180 may be positioned, a control system (e.g., a distributed controller, a central controller) configured to operate any of the components described above, communications equipment (e.g., wired and/or wireless communications circuitry), other flow control equipment (e.g., chokes, blowout preventers, compressors), fluid injection systems, and so forth.

In the second operating mode, the combined motor and generator 184 may operate as an electric motor configured to drive rotation of the combined compressor and turbine 182 to increase pressure of the resource flow, thereby driving resource flow from the reservoir 188 through the well 190 (e.g., toward the combined compressor and turbine 182). In this manner, the combined compressor and turbine 182 may operate as a compressor in the second operating mode. The combined motor and generator 184 may consume energy in the second operating mode. For example, the combined motor and generator 184 may receive energy from the electrical grid 138. The combined motor and generator 184 may additionally or alternatively receive energy from another energy source, such as an energy storage (e.g., one or more batteries configured to store energy generated by the combined motor and generator 184 in the first operating mode), a renewable energy source (e.g., a wind turbine, a solar cell), and the like.

The resource extraction system 180 may include or be communicatively coupled to a control system or circuitry 202 (e.g., the data processing system 60, an automation controller, a programmable controller, an electronic controller). The control system 202 may be configured to operate the resource extraction system 180, such as in the first operating mode and in the second operating mode. For example, the control system 202 may include a memory 204, which may include volatile memory, such as random access memory (RAM), and/or non-volatile memory, such as read-only memory (ROM), optical drives, hard disc drives, solid-state drives, or any other non-transitory computer-readable medium that stores instructions 206 thereon. The control system 202 may also include processing circuitry 208, which may be configured to execute the instructions 206 stored on the memory 204. For example, the processing circuitry 208 may include one or more application specific integrated circuits (ASICs), one or more field programmable gate arrays (FPGAs), one or more general purpose processors, or any combination thereof. The control system 202 may be communicatively coupled to the combined motor and generator 184 to operate the resource extraction system 180. To this end, the control system 202 may include communication circuitry 210, which may be a wireless or wired communication component that may facilitate establishing a connection to enable communication and control.

The communication circuitry, for example, may include any suitable communication protocol including Wi-Fi, mobile telecommunications technology (e.g., 2G, 3G, 4G, 5G, LTE), Bluetooth®, near-field communications technology, a network interface, and the like.

In some embodiments, the control system 202 may be configured to operate the resource extraction system 180 based on an operating parameter. For instance, the control system 202 may be communicatively coupled to one or more sensors 212 configured to monitor the operating parameter. The control system 202 may receive data from the sensor(s) 212 and operate the resource extraction system 180 based on the data, which may be indicative of the monitored operating parameter. As an example, the operating parameter may include a pressure of the resource flow (e.g., through the well 190 between the combined compressor and turbine 182 and the reservoir 188, through the well 190 between the combined compressor and turbine 182 and the pipeline system 128, through the pipeline system 128). In response to a determination that the pressure of the resource flow is above a threshold pressure, the control system 202 may operate the resource extraction system 180 in the first operating mode to reduce the pressure of the resource flow. For example, the control system 202 may operate the combined motor and generator 184 to apply a torque (e.g., no torque, a relatively low torque) that would enable the resource flow to drive rotation of the combined compressor and turbine 182 and cause a pressure drop of the resource flow. The torque applied during the first operating mode may be a resistive torque that causes the combined compressor and turbine 182 to resist rotation caused by the resource flow. The resistive torque may be adjusted, such as by applying a particular electrical load to the combined compressor and turbine 182 via the combined motor and generator 184, to change an amount of corresponding torque needed (e.g., to be exerted by the resource flow) to cause rotation of the combined compressor and turbine 182 to generate electricity.

In certain embodiments, the control system 202 may operate the combined motor and generator 184 to reduce the pressure of the resource flow toward a first target pressure, which may be more suitable to flow through the resource extraction system (e.g., the pipeline system 128). As an example, the control system 202 may increase the resistive torque applied by (e.g., increase an electrical load of) the combined motor and generator 184 to increase flow resistance imparted onto the resource flow, thereby increasing the mechanical energy extracted from the resource flow to cause increased pressure drop of the resource flow. As another example, the control system 202 may reduce the resistive torque applied by (e.g., reduce an electrical load of) the combined motor and generator 184 to reduce flow resistance of flow imparted onto the resource flow and cause reduced pressure drop of the resource flow. In this manner, the control system 202 may adjust the resistive torque applied by the combined motor and generator 184 in the first operating mode to control the amount of pressure reduction provided to the resource flow.

In response to a determination that the pressure of the resource flow is below the threshold pressure or an additional threshold pressure below the threshold pressure, the control system 202 may operate the resource extraction system 180 in the second operating mode to increase the pressure of the resource flow. As an example, in the second operating mode the control system 202 may operate the combined motor and generator 184 to apply a torque (e.g., a relatively high amount of torque) that drives rotation of the combined compressor and turbine 182 to pressurize the resource flow, thereby urging flow of resource from the reservoir 188 for extraction. The torque applied during the second operating mode may be a driving torque that is sufficient to cause the combined compressor and turbine 182 to rotate to perform compression. The driving torque may be adjusted based on a desirable amount or degree of compression of the resource flow. For instance, the control system 202 may operate the combined motor and generator 184 to increase the pressure of the resource flow toward a second target pressure, which may be similar to the first target pressure associated with the first operating mode. For example, the compressor may include a variable capacity compressor, a variable speed compressor, and/or a multi-stage compressor, and the control system 202 may adjust a capacity, a speed, and/or a stage of the combined compressor and turbine 182 to increase pressurization of the resource flow. The control system 202 may also adjust a capacity, a speed, and/or a stage of the combined compressor and turbine 182 to reduce pressurization of the resource flow.

In additional or alternative embodiments, the control system 202 may operate the resource extraction system 180 based on another type of operating parameter. By way of example, the control system 202 may operate the resource extraction system 180 based on a flow rate of resource (e.g., through the well 190, through the pipeline system 128), a rotational speed of the combined compressor and turbine 182, a rotation speed of the combined motor and generator 184, a period of time associated with the reservoir 188 (e.g., a life cycle associated with the reservoir 188), and/or any other suitable operating parameter.

In the illustrated embodiment, the control system 202 may operate the resource extraction system 180 in the first operating mode or the second operating mode using the same combined motor and generator 184 and/or the same combined compressor and turbine 182. To this end, the combined compressor and turbine 182 may be reversible to transition between operating as a compressor to drive flow of the resource and operating as a turbine that is driven by the flow of the resource. As such, the illustrated resource extraction system 180 may transition between operation in the first operating mode and the second operating mode without having to modify, install, remove, or otherwise update components of the resource extraction system 180, thereby reducing a cost and/or complexity associated with operating the resource extraction system 180 in the first operating mode and/or in the second operating mode. Furthermore, using the same combined motor and generator 184 and/or the same combined compressor and turbine 182 for multiple operating modes may reduce a cost and/or complexity associated with manufacture of the resource extraction system 180, such as in comparison with a resource extraction system that has respective, dedicated components for operation in the first operating mode and in the second operating mode.

Figure 6:
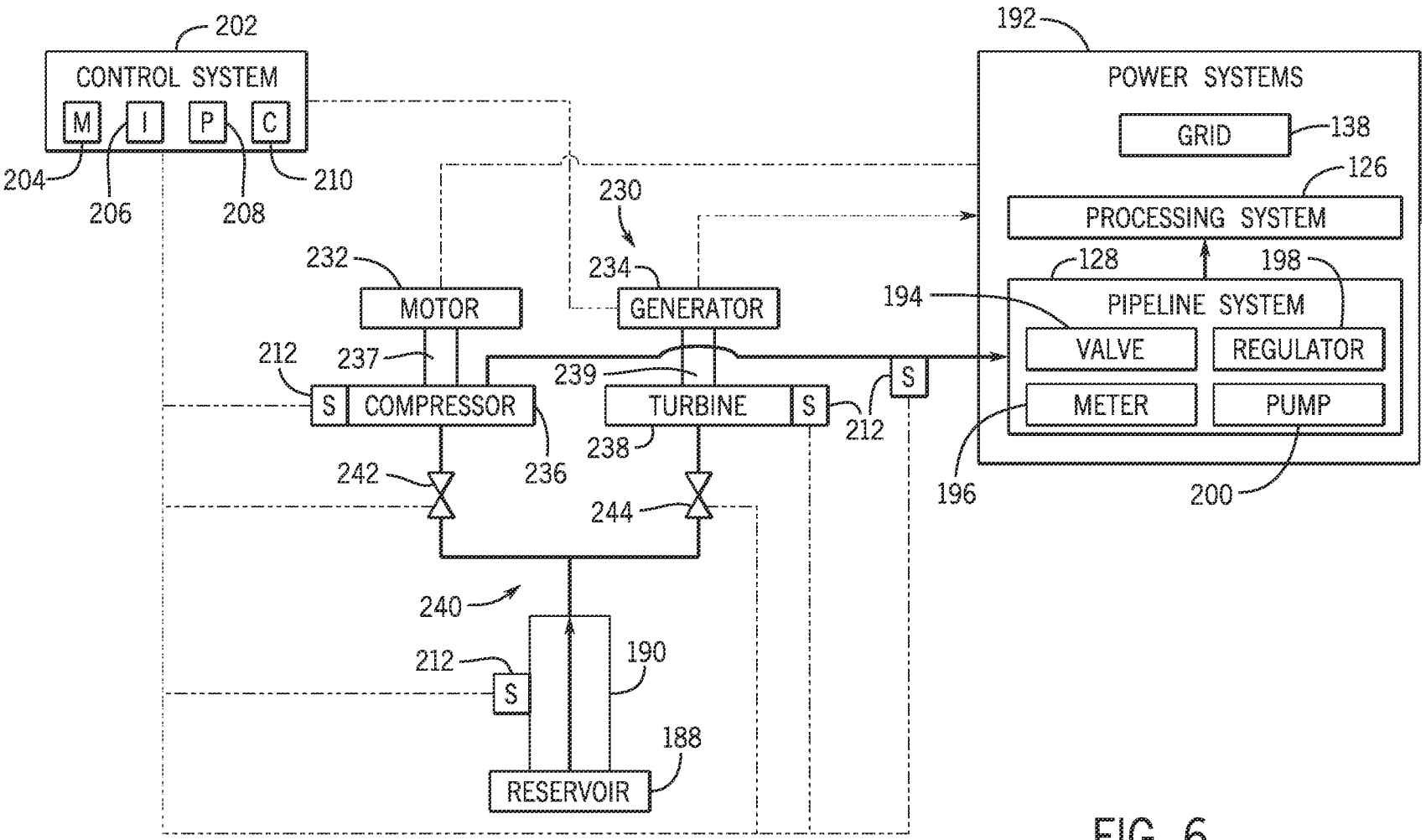
FIG. 6 is a schematic illustration of a resource extraction system that includes a separate compressor and turbine, according to an embodiment of the present disclosure.

FIG. 6 is a schematic illustration of an embodiment of a resource extraction system 230, which may be representative of any of the resource extraction systems 102, 112, 120. The resource extraction system 230 may extract resources from the reservoir 188 via the well 190, and the illustrated resource extraction system 230 includes a separate motor 232 and generator 234, as well as a separate compressor 236, which may be coupled to the motor 232 via a first shaft 237, and a separate turbine 238, which may be coupled to the generator 234 via a second shaft 239. Additionally, the resource extraction system 230 may include a conduit system 240, which may include a conduit, tubing, or piping fluidly coupling the well 190 to the compressor 236 and the turbine 238. The conduit system 240 may control flow of the resource to the compressor 236 and/or the turbine 238, such as based on the operating mode of the resource extraction system 230.

The control system 202 may be configured to operate the motor 232, the generator 234, and/or the conduit system 240 to operate the resource extraction system 230 in different operating modes. For example, in response to determining that the pressure of resource flow is above the threshold pressure, the control system 202 may operate the resource extraction system 230 in the first operating mode to reduce the pressure of the resource flow and direct the resource flow from the reservoir 188 to the turbine 238 for flow to the pipeline system 128 and/or the resource processing system 126. Additionally, the control system 202 may block resource flow from the reservoir 188 to the compressor 236 and suspend operation of the compressor 236. For instance, the conduit system 240 may include a first valve 242, which may be configured to control resource flow between the well 190 and the compressor 236, and a second valve 244, which may be configured to control resource flow between the well 190 and the turbine 238. During the first operating mode, the control system 202 may cause the first valve 242 to adjust to a closed position to block resource flow from the well 190 to the compressor 236, and the control system 202 may cause the second valve 244 to adjust to an open position to enable resource flow from the well 190 to the turbine 238. In this manner, the resource flow may be directed through the turbine 238 and cause rotation of the turbine 238, which may reduce the pressure of the resource flow and also drive rotation of the generator 234 via the second shaft 239 to generate energy. The energy may then be utilized to enable operation of the power systems 192, for example. The control system 202 may adjust operation of the generator 234 (e.g., to adjust a flow resistance imparted by the turbine 238) to control the pressure reduction of the resource flow, such as toward the first target pressure.

In response to determining that the pressure of the resource flow is below the threshold pressure, the control system 202 may operate the resource extraction system 230 in the second operating mode to pressurize the resource flow via the compressor 236 for flow to the pipeline system 128 and/or the resource processing system 126. Additionally, the control system 202 may block resource flow from the reservoir 188 to the turbine 238 and suspend operation of the turbine 238. To this end, the control system 202 may cause the first valve 242 to adjust to an open position to enable resource flow from the well 190 to the compressor 236, and the control system 202 may cause the second valve 244 to adjust to a closed position to block resource flow from the well 190 to the turbine 238. As such, the compressor 236 may pressurize the resource flow in the second operating mode. For example, the control system 202 may operate the motor 232 in the second operating mode to control pressurization of the resource flow, such as toward the second target pressure. The motor 232 may consume energy during operation in the second operating mode.

The control system 202 may operate the resource extraction system 230 based on data received from the sensor(s), such as data that indicates the pressure of the resource flow. The control system 202 may also operate the resource extraction system 230 based on other operating parameters, such as respective rotational speeds of the motor 232, the generator 234, the compressor 236, and/or the turbine 238, a flow rate of the resource flow (e.g., through the conduit system 240, the well 190, the pipeline system 128), and/or any other suitable operating parameter.

In the illustrated embodiment, the control system 202 may independently operate separate components of the resource extraction system 230 in the first operating mode and in the second operating mode. For example, the control system 202 may operate the generator 234 and suspend operation of the motor 232 in the first operating mode, and the control system 202 may operate the motor 232 and suspend operation of the generator 234 in the second operating mode. In this manner, the generator 234 and the turbine 238 may be dedicated for operation in the first operating mode, and the motor 232 and compressor 236 may be dedicated for operation in the second operating mode.

Implementing separate components for operation in the different operating modes may improve configurability and/or customization of the resource extraction system 230, such as to implement certain embodiments of components that provide efficient operation in the different operation modes. As an example, a particular type and/or specification of the generator 234 and/or turbine 238 may be selected based on an operating characteristic of the resource extraction system 230, such as a pressure of resource flow through the turbine 238, a flow rate of the resource through the turbine 238, a rotational speed caused by flow of the resource through the turbine 238, and so forth, to achieve efficient operation of the generator 234 to generate electrical energy in the first operating mode (e.g., increase an amount of energy being generated) and/or to achieve efficient operation of the turbine 238 to reduce the pressure of the resource flow in the first operating mode. As another example, a particular type and/or specification of the compressor 236 may be selected based on an operating characteristic of the resource extraction system 230 to achieve efficient operation of the motor 232 and/or the compressor 236 to increase the pressure of the resource flow in the second operating mode. Thus, the motor 232, the generator 234, the compressor 236, and/or the turbine 238 may be individually selected to provide desirable performance of the resource extraction system 230 in the first operating mode and in the second operating mode.

Figure 7:
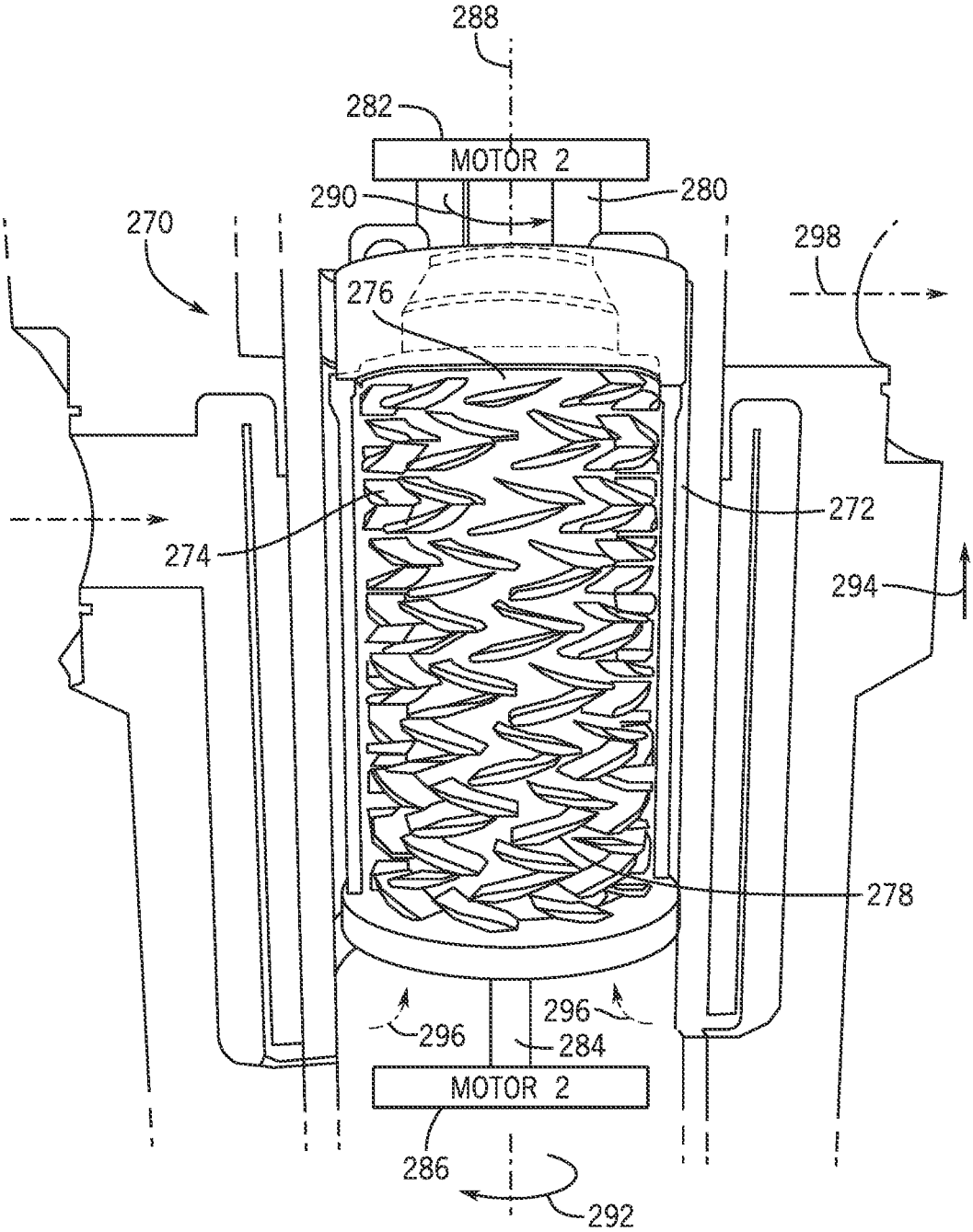
FIG. 7 is a cross-sectional side view of a compressor that may be employed in a resource extraction system, according to an embodiment of the present disclosure.

FIG. 7 is a cross-sectional side view of an embodiment of a compressor 270 that may be employed in any of the resource extraction systems described herein. The compressor 270 may include an embodiment as described in U.S. Pat. No. 9,476,427, herein incorporated by reference in its entirety for all purposes. The compressor 270 may include an outer assembly 272 having outer blades 274 (e.g., coupled to an inner surface of the outer assembly 272) and an inner assembly 276 having inner blades 278 (e.g., coupled to an outer surface of the inner assembly 276). The inner assembly 276 may be concentrically aligned with and positioned within the outer assembly 272 to interleave the outer blades 274 and the inner blades 278 with one another. That is, the outer blades 274 and the inner blades 278 may be in an alternating arrangement along the assemblies 272, 276. The outer assembly 272 may include a first shaft 280 driven by a first motor 282 (e.g., a part of the combined motor and generator 184), such as via the control system 202. The inner assembly 276 may include a second shaft 284 driven by a second motor 286 (e.g., a part of the combined motor and generator 184), such as via the control system 202.

During operation to pressurize resource flow, the motors 282, 286 may drive rotation of the assemblies 272, 276, respectively, about a common rotational axis 288. For example, the first motor 282 may drive rotation of the outer assembly 272 in a first rotational direction 290, and the second motor 286 may drive rotation of the inner assembly 276 in a second rotational direction 292, opposite the first rotational direction 290. Each of the outer blades 274 may be oriented to drive the resource flow in a flow direction 294 (e.g., an upward direction) generally along the rotational axis 288 during rotation of the outer assembly 272 in the first rotational direction 290. Each of inner blades 278 may be oriented to drive the resource flow in the flow direction 294 during rotation of the inner assembly 276 in the second rotational direction 292. For instance, the outer blades 274 and the inner blades 278 may be oriented opposite one another so as to cooperatively form a V-shaped arrangement.

Thus, during operation to pressurize resource flow, the outer blades 274 and the inner blades 278 may collectively drive the resource flow in the flow direction 294. As an example, the assemblies 272, 276 may receive flow of the resource in intake directions 296. The blades 274, 278 driven in opposite rotational directions 290, 292 may then cooperatively compress the resource flow and drive movement of the resource in the flow direction 294. In this manner, each row of blades 274, 278 may iteratively compress the resource flow directed in the flow direction 294 through the assemblies 272, 276 to provide efficient compression of the resource flow. Additionally, the blades 274, 278 may compress the resource flow without implementation of other components, such as a diffuser and/or a vane, that may cause separation of the resource flow into gas and liquid phases and potentially cause reduced performance (e.g., efficiency) of the compressor 270. As such, the blades 274, 278 may efficiently pressurize a homogeneous flow (e.g., a flow having a consistent mixture between gas and liquid phases) of the resource through the compressor 270. The compressor 270 may then discharge the pressurized resource flow in a discharge direction 298.

In some embodiments, the compressor 270 may be reversible and may operate as a turbine, such as in the first operating mode of the resource extraction system. As an example, the resource flow (e.g., in the flow direction 294) may drive movement of the blades 274, 278 to cause rotation of the assemblies 272, 276. For instance, the resource flow may drive rotation of the outer assembly 272 in the first rotational direction 290 and rotation of the inner assembly 276 in the second rotational direction 292. The respective rotations of the assemblies 272, 276 in the rotational directions 290, 292 may generate electrical energy. That is, the respective rotations of the assemblies 272, 276 driven by the resource flow may cause rotation of the motors 282, 286 via the shafts 280, 284 and cause the motors 282, 286 to operate as generators and generate electrical energy. The electrical energy may then be distributed for usage by a power system that may be electrically coupled to the compressor 270.

Figure 8:
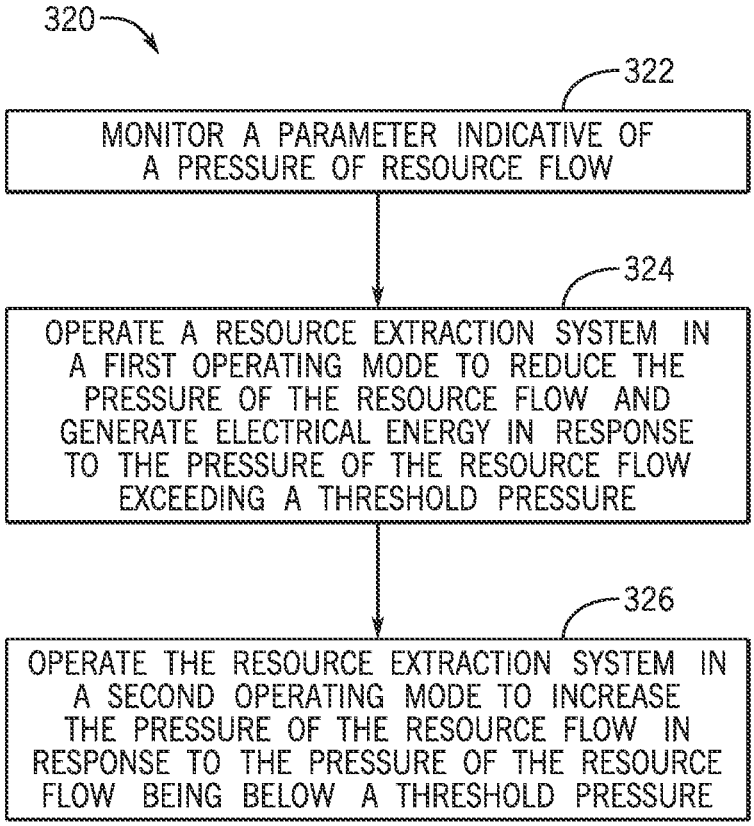
FIG. 8 is a flowchart of a method for operating a resource extraction system, according to an embodiment of the present disclosure.

FIG. 8 is a flowchart of an embodiment of a method 320 for operating any of the resource extraction systems having a compressor and turbine system, as described herein. Any suitable device (e.g., the processing circuitry 208 of the control system 202) may perform the method 320. In one embodiment, the method 320 may be implemented by executing instructions (e.g., the instructions 206) stored in a tangible, non-transitory, computer-readable medium (e.g., the memory 204). For example, the method 320 may be performed at least in part by one or more software components, one or more hardware components, one or more software applications, and the like. While the method 320 is described using operations in a specific sequence, additional operations may be performed, the described operations may be performed in different sequences than the sequence illustrated, and/or certain described operations may be skipped or not performed altogether.

At block 322, a parameter indicative of a pressure of resource flow may be monitored. For example, sensor data may be received, and the pressure of resource flow may be determined based on the sensor data. The pressure may include pressure of the resource flow in a well and/or in a pipeline system.

At block 324, the resource extraction system may be operated in a first operating mode to reduce the pressure of the resource flow in response to the pressure of the resource flow exceeding a threshold pressure. During the first operating mode, the compressor and turbine system may be enabled to rotate via the resource flow directed through the compressor and turbine system. For example, a resistive torque may be applied to the compressor and turbine system such that the resource flow may drive rotation of the compressor and turbine system. The pressure of the resource flow may be reduced as a result of the mechanical energy of the resource flow used to cause the rotation of the compressor and turbine system. Rotation of the compressor and turbine system may cause a generator coupled to the compressor and turbine system to generate electrical energy.

In some embodiments, the amount of pressure of the resource flow being reduced may be adjusted. As an example, the resistive torque applied to the compressor and turbine system may be adjusted to adjust a flow resistance applied by the compressor and turbine system. For instance, increasing the resistive torque may increase the flow resistance provided by the compressor and turbine system. Therefore, a greater amount of mechanical energy of the resource flow may be used to drive rotation of the compressor and turbine system, thereby increasing the pressure reduction of the resource flow. For example, the resistive torque may be adjusted to reduce the pressure of the resource flow toward a determined (e.g., pre-determined, user input) target pressure.

At block 326, the resource extraction system may be operated in a second operating mode to increase the pressure of the resource flow in response to the pressure of the resource flow being below the threshold pressure or an additional threshold pressure below the threshold pressure. During the second operating mode, the compressor and turbine system may be operated to drive rotation of the compressor and turbine system and pressurize the resource flow. For example, a driving torque may be applied to the compressor and turbine system to drive the compressor and turbine system to rotate and compress the resource flow. Electrical energy may be consumed to apply the driving torque that drives rotation of the compressor and turbine system (e.g., via a motor).

In certain embodiments, the amount of pressurization of the resource flow may be adjusted. As an example, the driving torque applied to the compressor and turbine system may be adjusted to adjust a capacity, a speed, and/or a stage of the compressor and turbine system and change the resulting pressurization of the resource flow. For instance, increasing the driving torque may increase pressurization of the resource flow. The driving torque may be adjusted to increase the pressure of the resource flow toward an additional determined target pressure. In certain embodiments, the additional determined target pressure associated with the second operating mode may be substantially equal to the determined target pressure associated with the first operating mode. In additional or alternative embodiments, the target pressures associated with the different operating modes may be different from one another.

In some embodiments, the same rotary device (e.g., a reversible compressor or a reversible turbine coupled to a combined motor and generator) of the compressor and turbine system may be used to operate the resource extraction system in the first operating mode and in the second operating mode. That is, in such embodiments, the same rotary device may operate as a turbine in the first operating mode and as a compressor in the second operating mode. Additionally or alternatively, the compressor and turbine system may include a separate compressor and turbine that may be separately operated in the different operating modes of the resource extraction system. For example, in the first operating mode, the turbine may be operated to reduce the pressure of the resource flow, and operation of the compressor may be suspended. For this reason, the resource flow may be blocked from being directed to the compressor, such as by closing a valve of a conduit system. In the second operating mode, the compressor may be operated to increase the pressure of the resource flow, and operation of the turbine may be suspended. As such, the resource flow may be blocked from being directed to the turbine, such as by closing another valve of the conduit system.

The method 320 may also be independently operated for different resource extraction systems. For example, respective pressures of resource flows associated with the different resource extraction systems may be determined, and a resource extraction system may be operated in the first operating mode or in the second operating mode based on a corresponding pressure of the associated resource flow. As such, different resource extraction systems may be operated in different operating modes. For instance, one of the resource extraction systems may be operated in the first operating mode while another one of the resource extraction systems may be operated in the second operating mode. In such embodiments, the respective threshold pressures to which the resource flows are compared may be substantially equal to one another. Additionally or alternatively, the respective pressures of the resource flows may be compared to different threshold pressures, such as threshold pressures that may be more suitable for resource flow based on the specifications of equipment (e.g., of the pipeline system, of the wells) implemented for the different resource extraction systems.

While the subject disclosure is described through the above embodiments, it will be understood by those of ordinary skill in the art that modification to and variation of the illustrated embodiments may be made without departing from the inventive concepts herein disclosed. Moreover, while some embodiments are described in connection with various illustrative structures, one skilled in the art will recognize that the system may be embodied using a variety of specific structures.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. A resource extraction system, comprising:

a compressor and turbine system configured to selectively operate in a first operating mode and a second operating mode based on a pressure of a resource flow from a reservoir extracted via a well, the compressor and turbine system comprising:

a combined compressor and turbine configured to function as a turbine driven by the resource flow while operating in the first operating mode and to function as a compressor to drive the resource flow while operating in the second operating mode, the combined compressor and turbine comprising an outer assembly having a plurality of outer blades and an inner assembly concentrically positioned within the outer assembly and having a plurality of inner blades interleaved in an alternating arrangement with the plurality of outer blades, wherein the outer assembly is configured to rotate in a first rotational direction and the inner assembly is configured to rotate in a second rotational direction opposite the first rotational direction, and wherein the plurality of outer blades and the plurality of inner blades are configured to compress the resource flow without a diffuser or vane to avoid separation of the resource flow into gas and liquid phases;

a combined motor and generator coupled to the combined compressor and turbine via a shaft, the combined motor and generator configured to function as a generator to generate electrical energy while the combined compressor and turbine is driven as a turbine in the first operating mode, the combined motor and generator configured to function as a motor driving the combined compressor and turbine as a compressor in the second operating mode; and an energy storage system configured to store the electrical energy generated by the combined motor and generator while operating in the first operating mode and to supply the stored electrical energy to drive the combined motor and generator while operating in the second operating mode; and a control system comprising processing circuitry and communicatively coupled to a sensor configured to monitor the pressure of the resource flow, wherein the control system is configured to:

operate the compressor and turbine system in the first operating mode in response to the sensor detecting the pressure of the resource flow exceeding a threshold pressure corresponding to an early stage of a life cycle of the reservoir; and operate the compressor and turbine system in the second operating mode in response to the sensor detecting the pressure of the resource flow falling below the threshold pressure corresponding to a later stage of the life cycle of the reservoir.

2. The resource extraction system of claim 1, wherein the control system is configured to cause the combined motor and generator to adjust a resistive torque applied to the turbine based on a target pressure of the resource flow to impart a flow resistance onto the resource flow via the combined compressor and turbine in the first operating mode and reduce the pressure of the resource flow toward the target pressure.

3. The resource extraction system of claim 1, wherein the control system is configured to operate the combined motor and generator based on a target pressure of the resource flow to drive rotation of the combined compressor and turbine in the second operating mode and increase the pressure of the resource flow toward the target pressure.

4. The resource extraction system of claim 1, wherein the compressor and turbine system are positioned at a sea floor, in the well, on a dry land surface, at an offshore system, or any combination thereof.

5. A non-transitory computer-readable medium comprising instructions that, when executed by processing circuitry, cause the processing circuitry to:

operate a resource extraction system in a first operating mode in response to determining a pressure of a resource flow extracted by the resource extraction system is above a threshold pressure to reduce the pressure of the resource flow via a combined compressor and turbine configured to receive the resource flow and be driven to rotate by the resource flow, the combined compressor and turbine configured to rotate a combined motor and generator via a shaft to generate electrical energy to be stored in a power system; and operate the resource extraction system in a second operating mode in response to determining that the pressure of the resource flow is below the threshold pressure to increase the pressure of the resource flow via the combined compressor and turbine, electrical energy from the power system used to drive the combined motor and generator to drive rotation of the combined compressor and turbine via the shaft;

wherein the combined compressor and turbine comprises an outer assembly having a plurality of outer blades and an inner assembly concentrically positioned within the outer assembly and having a plurality of inner blades interleaved in an alternating arrangement with the plurality of outer blades, wherein the outer assembly is configured to rotate in a first rotational direction and the inner assembly is configured to rotate in a second rotational direction opposite the first rotational direction, and wherein the plurality of outer blades and the plurality of inner blades are configured to compress the resource flow without a diffuser or vane to avoid separation of the resource flow into gas and liquid phases.

6. The non-transitory computer-readable medium of claim 5, wherein the instructions, when executed by the processing circuitry, cause the processing circuitry to receive data from a sensor, wherein the data comprises the pressure of the resource flow in a well through which the resource flow is directed for extraction via the resource extraction system.

7. A system, comprising:

a compressor and turbine system configured to selectively operate in a first operating mode and a second operating mode based on a pressure of a resource flow from a reservoir received via a well, the compressor and turbine system comprising:

a combined compressor and turbine configured to function as a turbine driven by the resource flow while operating in the first operating mode and to function as a compressor to drive the resource flow while operating in the second operating mode, the combined compressor and turbine comprising an outer assembly having a plurality of outer blades and an inner assembly concentrically positioned within the outer assembly and having a plurality of inner blades interleaved in an alternating arrangement with the plurality of outer blades, wherein the outer assembly is configured to rotate in a first rotational direction and the inner assembly is configured to rotate in a second rotational direction opposite the first rotational direction, and wherein the plurality of outer blades and the plurality of inner blades are configured to compress the resource flow without a diffuser or vane to avoid separation of the resource flow into gas and liquid phases;

a combined motor and generator coupled to the combined compressor and turbine via a shaft, the combined motor and generator configured to function as a generator to generate electrical energy while the combined compressor and turbine is driven as a turbine in the first operating mode, the combined motor and generator configured to function as a motor driving the combined compressor and turbine as a compressor in the second operating mode; and a power system configured to store the electrical energy generated by the combined motor and generator while operating in the first operating mode and to supply the stored electrical energy to drive the combined motor and generator while operating in the second operating mode; and a control system comprising processing circuitry and communicatively coupled to a sensor configured to monitor the pressure of the resource flow, wherein the control system is configured to:

operate the compressor and turbine system in the first operating mode in response to the sensor determining the pressure of the resource flow exceeds a threshold pressure; and operate the compressor and turbine system in the second operating mode in response to the sensor determining the pressure of the resource flow is below the threshold pressure.

8. The system of claim 7, comprising a pipeline system configured to receive the resource flow from the compressor and turbine system and direct the resource flow, wherein the pipeline system is configured to consume the electrical energy stored in the power system.

9. The system of claim 7, comprising a connector electrically coupling the compressor and turbine system to the power system, wherein the compressor and turbine system is configured to distribute the electrical energy generated by the compressor and turbine system to the power system via the connector, and the compressor and turbine system is configured to receive additional electrical energy from the power system via the connector to pressurize the resource flow.

10. The system of claim 7, comprising an additional compressor and turbine system configured to receive an additional resource flow from an additional reservoir, wherein the control system is configured to:

operate the additional compressor and turbine system to enable the additional resource flow to drive rotation of the additional compressor and turbine system to reduce an additional pressure of the additional resource flow and generate additional electrical energy via the rotation of the additional compressor and turbine system in response to determining the additional pressure of the additional resource flow exceeds an additional threshold pressure; and operate the additional compressor and turbine system to pressurize the additional resource flow in response to determining the additional pressure of the additional resource flow is below the additional threshold pressure.

* * * * *